US005403144A

United States Patent [19]

Staben, Jr.

[11] Patent Number: 5,403,144

[45] Date of Patent: Apr. 4, 1995

[54] BLADE TILT ASSEMBLY FOR A FRONT END LOADER

[76] Inventor: Frank P. Staben, Jr., P.O. Box 869, Oxnard, Calif. 93032

[21] Appl. No.: 51,331

[22] Filed: Apr. 23, 1993

[51] Int. Cl.[6] ..... E02F 3/76

[52] U.S. Cl. ..... 414/697; 414/723; 92/165 R; 37/468

[58] Field of Search ..... 414/697, 723; 172/821-826; 37/271, 218, 468; 92/165 R, 161

[56] References Cited

U.S. PATENT DOCUMENTS

| | | | |
|---|---|---|---|
| 2,239,943 | 4/1941 | Sword | 172/824 |
| 2,839,848 | 6/1958 | Mackey . | |
| 2,925,802 | 2/1960 | White, Jr. . | |
| 3,011,276 | 12/1961 | Likely | 172/823 |
| 3,231,117 | 10/1962 | Melroe et al. . | |
| 3,246,406 | 4/1966 | Ray, Jr. . | |
| 3,395,764 | 8/1968 | Writ . | |
| 3,580,341 | 5/1971 | Terrell et al. . | |
| 3,653,451 | 4/1972 | Fryrear et al. | 172/824 |
| 3,662,841 | 5/1992 | Molby et al. . | |
| 3,672,521 | 6/1972 | Bauer et al. . | |
| 3,698,490 | 10/1972 | King . | |
| 3,926,263 | 12/1975 | Frisbee et al. . | |
| 4,013,132 | 3/1977 | Matsuzawa . | |
| 4,019,588 | 4/1977 | Casey . | |
| 4,083,414 | 4/1978 | Yokoyama et al. . | |
| 4,187,766 | 2/1980 | Gaylord | 92/165 R X |
| 4,828,044 | 5/1989 | Horsch et al. | 172/824 X |
| 4,848,483 | 7/1989 | Heiple . | |
| 4,999,022 | 3/1991 | Veys . | |
| 5,069,296 | 12/1991 | Horsch . | |
| 5,107,610 | 4/1992 | Fusco | 414/723 X |
| 5,237,909 | 8/1993 | Pirhadi | 92/161 |

FOREIGN PATENT DOCUMENTS

| | | | |
|---|---|---|---|
| 0713954 | 2/1980 | U.S.S.R. | 172/825 |

*Primary Examiner*—Donald W. Underwood
*Attorney, Agent, or Firm*—Kelly Bauersfeld & Lowry

[57] ABSTRACT

An improved blade tilt assembly is provided for adjusting the lateral tilt of a scoop or bucket mounted on a front end loader. The front end loader normally includes frame arms supporting the scoop at the front of the vehicle, in combination with at least one hydraulic lift unit and an hydraulic fore-aft pitch control unit. The blade tilt assembly includes a pair of hydraulic tilt units of reinforced construction, and connected between the frame arms and the scoop respectively at laterally opposite ends thereof. The tilt units are operated in tandem to respectively raise and lower the opposite ends of the scoop in substantially equal increments, thereby adjusting the lateral tilt angel of the scoop.

11 Claims, 3 Drawing Sheets

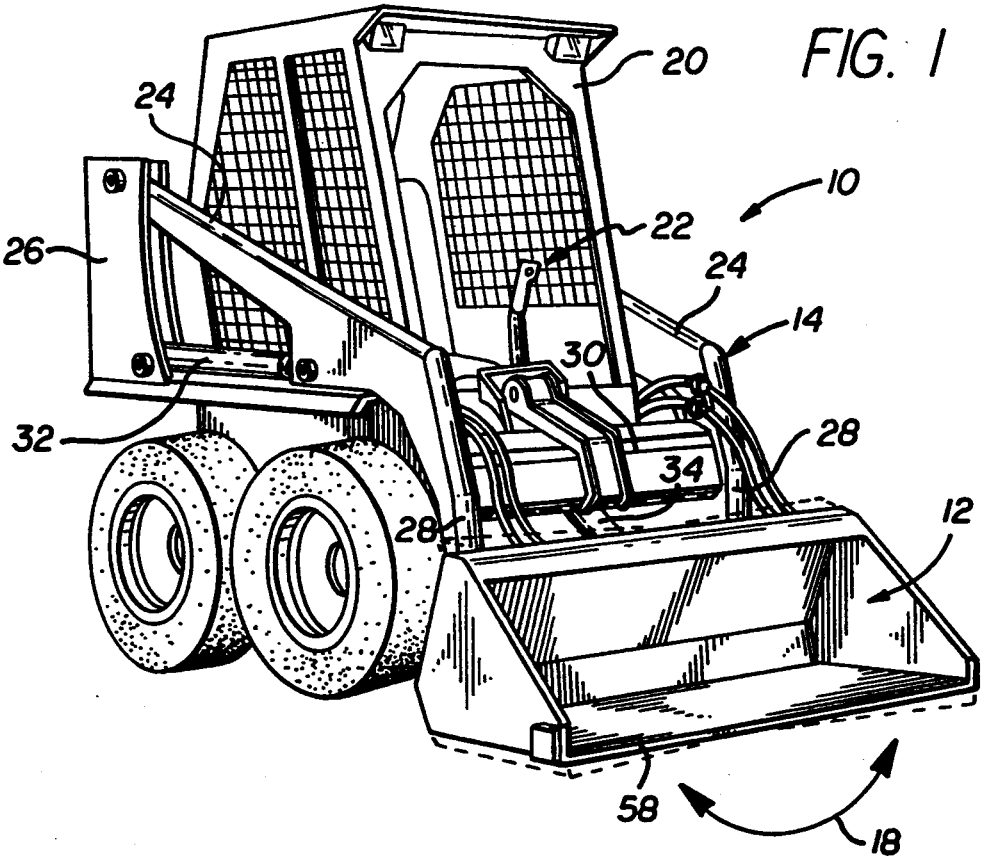
FIG. 1
FIG. 6
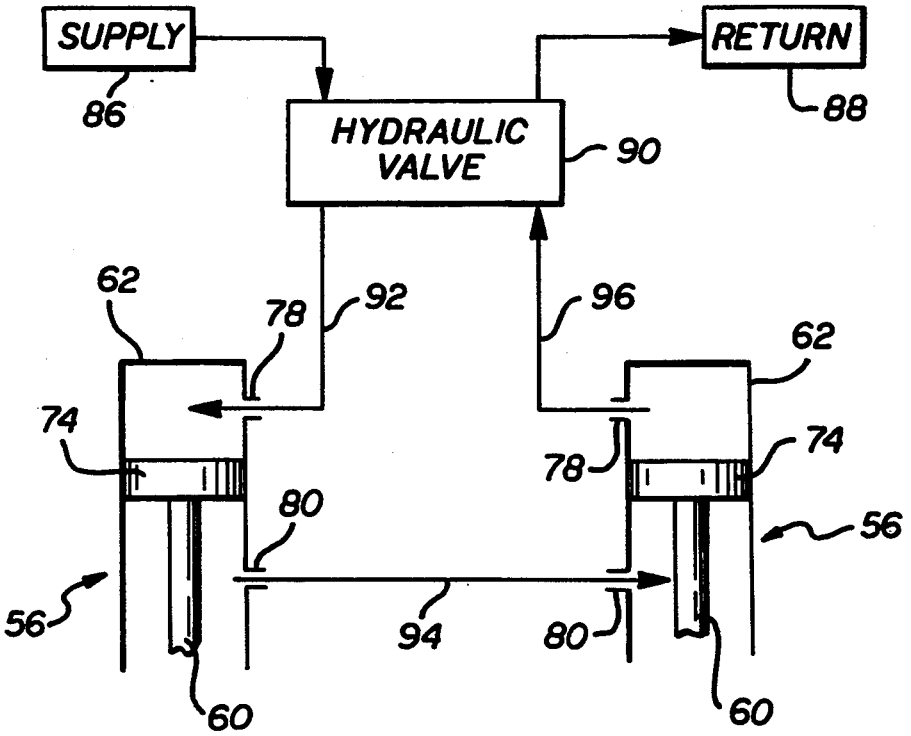

BLADE TILT ASSEMBLY FOR A FRONT END LOADER

BACKGROUND OF THE INVENTION

This invention relates generally to improvements in so-called front end loaders of the type having an hydraulically operated frame for supporting and manipulating a bucket or scoop or other work attachment at the front of the vehicle. More specifically, this invention relates to an improved blade tilt assembly of a relatively compact and simplified design for adjusting the lateral tilt of the scoop or bucket or other attachment on the front end loader. The blade tilt assembly is particularly suited for use with relatively small so-called skid-steer front end loaders of the general type described in U.S. Pat. Nos. 3,231,117 and 3,672,521.

Front end loaders are generally known in the art for use in performing a wide range of grading, digging, construction, and other related tasks. In general terms, front end loaders typically comprise a tractor-type vehicle equipped with a pivoting frame having a selected work attachment such as a scoop or bucket connected thereto. Hydraulic actuator units are provided on the vehicle for controlled raising and lowering of the pivoting frame, in combination with controlled fore-aft pitch adjustment of the work attachment. Appropriate manipulation of the hydraulic actuator units enables the work attachment to be correspondingly manipulated to perform a specific desired task.

An exemplary front end loader is shown and described in U.S. Pat. No. 3,231,117, generally in conformance with so-called skid-steer loaders marketed by Melroe Company, Division of Clark Equipment Company, Fargo, N. Dak., under the trademark BOBCAT. Such front end loaders are adapted for relatively rapid and interchangeable mounting of different work attachments, such as scoops or buckets, dozer blades, fork lift apparatus, rotary sweepers, jackhammer and auger devices, etc. In this regard, front end loaders of this type are frequently equipped with an adapter mounting plate of the type described in U.S. Pat. No. 3,672,521, to facilitate relatively rapid interchangement of work attachments.

In many earth-moving or grading applications, the specific lateral tilt angle of the work attachment such as a scoop or bucket can be an important factor contributing to rapid completion of the desired task. By way of example, it may be extremely desirable to orient the scoop or bucket with a specific lateral tilt in the course of a landscape grading operation, or in the course of digging a swimming pool or the like to have a sloped floor surface. In this regard, a variety of mechanisms have been proposed throughout the prior art to permit such blade tilt adjustment. However, such prior art devices have typically been relatively complex and costly, frequently having a size and weight which can adversely affect the center of gravity and thus alter the maneuverability of the vehicle. Moreover, such tilt mechanisms have not been well suited for use with a relatively compact front end loader of the type described in U.S. Pat. No. 3,231,117, nor have such mechanisms been satisfactory for use with adapter mounting plates of the type described in U.S. Pat. No. 3,672,521.

Furthermore, prior tilt adjustment mechanisms have frequently been limited to hydraulic mechanisms for raising and lower one end of the scoop or bucket on the front end loader. Such single-end devices inherently require attachment support mechanisms such as ball joints or slide tracks or similar bearing support structures which exhibit relatively high wear and resultant short life-span in earth-moving applications. Moreover, raising and lowering of one end of the bucket or scoop also inherently skews the angle of attack of the work attachment, such that soil grading or shaping at significant tilt angles may not be possible.

The present invention overcomes the many problems and disadvantages presented in the prior art, by providing an improved blade tilt assembly for a front end loader, wherein the blade tilt assembly has a relatively compact and simplified design which may be conveniently used with an adapter mounting plate of the type described in U.S. Pat. No. 3,672,521. Moreover, the blade tilt assembly of the present invention provides substantially sealed bearing and support mechanisms which accommodate bidirectional raising and lowering of the opposite ends of the work attachment in substantially equal increments.

SUMMARY OF THE INVENTION

In accordance with the invention, an improved blade tilt assembly is provided for adjusting the lateral tilt of a work attachment such as a scoop or bucket mounted on frame arms at the front end of a front end loader. The blade tilt assembly includes a pair of reinforced and substantially sealed hydraulic tilt units connected between the frame arms and the work attachment, or to an adapter mounting plate connected to the work attachment, generally at the laterally opposite ends thereof. The pair of tilt units are operated in tandem to displace the opposite ends of the work attachment in substantially equal and opposite directions, thereby raising one end while lowering the opposite end. With this construction, the tilt angle of the work attachment can be adjusted bidirectionally, without skewing the angle of attack.

In the preferred form, the front end loader includes a pair of frame arms connected to the vehicle for vertical positional adjustment in response to operation of at least one hydraulic lift unit. The front ends of the frame arms are connected generally to opposite ends of a work attachment such a scoop or bucket, or to opposite ends of an adapter mounting plate designed for quick release removable connection to the work attachment. An hydraulic pitch control unit is connected between the vehicle and a laterally centered point on the work attachment, or adapter mounting plate therefor, to select and control fore-aft pitch position.

The frame arms are connected to the work attachment, or to the adapter mounting plate therefor, by a pair of hydraulic tilt units. More specifically, the frame arms include transversely extending and coaxially aligned link pins connected respectively to the lower ends of a pair of hydraulic rams of the two tilt units. The hydraulic rams extend upwardly into a corresponding pair of hydraulic cylinders each mounted onto the work attachment, or adapter mounting plate therefor, by means of a relatively large trunnion bearing oriented to permit rotation of the hydraulic cylinder about an axis extending generally in a fore-aft direction. The trunnion bearings are respectively carried in mounting brackets disposed generally at laterally opposite ends of the work attachment.

The hydraulic tilt units are connected in series in a common hydraulic circuit for respectively raising and lowering the laterally opposite ends of the work attachment in equal and opposite increments. Thus, one end of the work attachment is raised while the opposite end is lowered through an equal increment, or vice versa. An operator controlled selector valve permits appropriate connector of this hydraulic circuit to an hydraulic fluid supply and return, in order to select the direction of tilt motion. With this construction, the lateral tilt angle of the work attachment such as a scoop or bucket can be bidirectionally adjusted, without skewing the angle of attack.

In accordance with a further aspect of the invention, the hydraulic rams of the tilt units have a relatively large cross sectional size and extend into their respective hydraulic cylinders for reinforced slide-fit support within elongated sleeve bearings. With this construction, the hydraulic rams are slidably supported for a substantial portion of their lengths, and substantially concealed within the hydraulic cylinders, thereby structurally reinforcing the hydraulic rams and protecting the tilt units against significant wear attributable to contact with dirt and the like.

Other features and advantages of the invention will become more apparent from the following detailed description, taken in conjunction with with accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating a front end loader having a work attachment such as a scoop or bucket adapted for bidirectional lateral tilt adjustment, in accordance with the invention;

FIG. 6 is an hydraulic circuit diagram depicting operation of the blade tilt assembly of the present invention.

DETAILED DESCRIPTION OF THE PREFERRED EMBODIMENT

Figure 2:
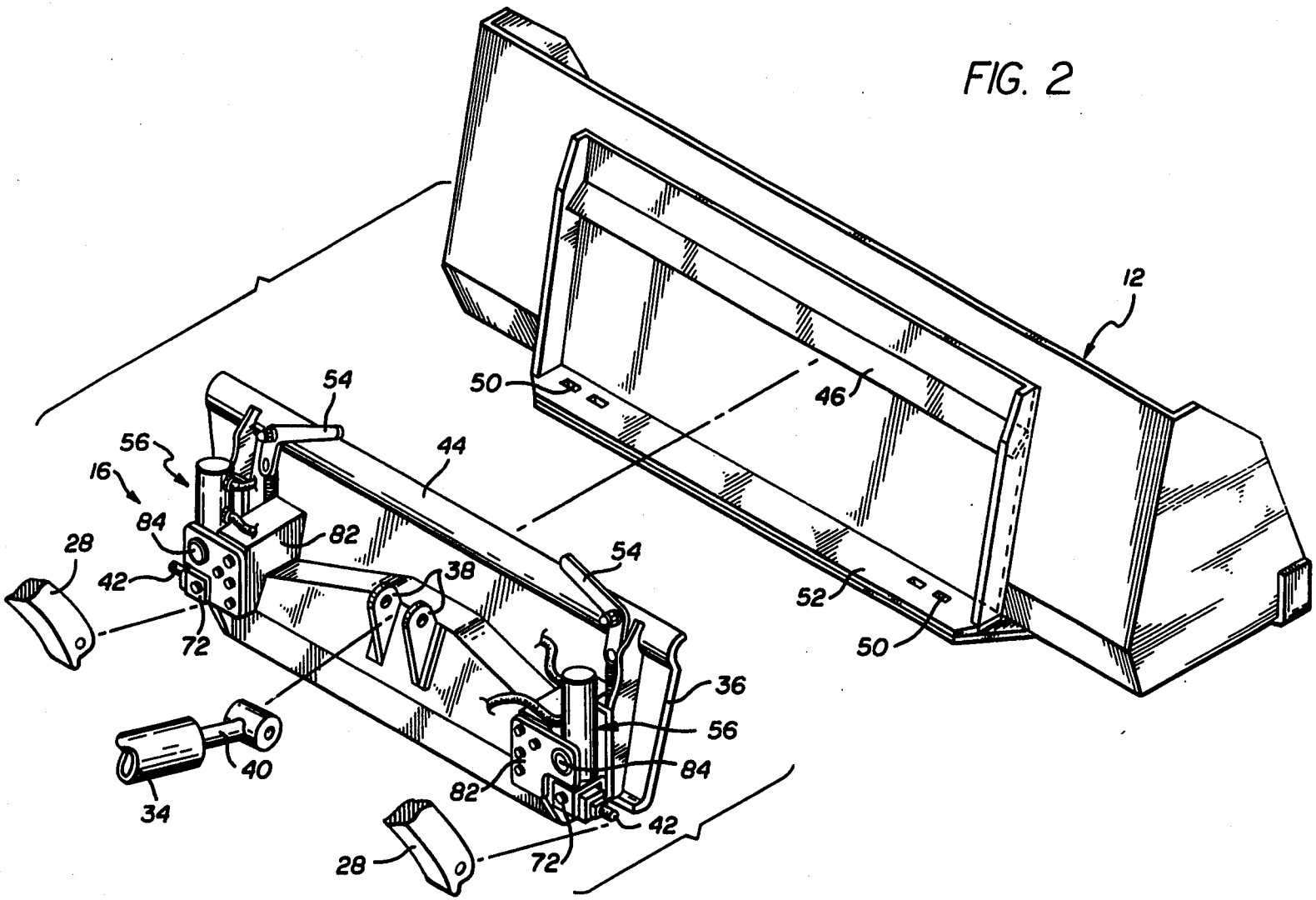
FIG. 2 is an enlarged fragmented and exploded rear perspective view illustrating the blade tilt assembly of the present invention in conjunction with a removably mounted work attachment.

As shown in the exemplary drawings, a front end loader referred to generally in FIG. 1 by the reference numeral 10 includes a removably mounted work attachment 12 such as a scoop or bucket for performing a variety of tasks, such as earth-moving, grading, etc. The front scoop 12 is mounted onto a lift frame 14 by means of an improved blade tilt assembly 16 (FIG. 2) which provides bidirectional lateral tilt adjustment of the scoop 12, as indicated by arrow 18 in FIG. 1.

The front end loader 10 generally comprises a power-driven vehicle having an operator's cab 20 with suitable controls 22 for driving and steering the vehicle, and for manipulating the work attachment 12 to perform a selected task or tasks. In this regard, FIG. 1 shows the vehicle to include the pivotal lift frame 14 defined by a pair of frame lift arms 24 extending along opposite sides of the vehicle from a pivot base 26 to front lower ends 28 adapted for connection to the work attachment 12, as will be described in more detail. The lift arms 24 are interconnected at the front of the vehicle by a cross brace 30. Each lift arm 24 is associated with an hydraulic lift unit 32, one of which is shown in FIG. 1, for raising and lowering the frame 14 and the work attachment 12 connected thereto, all in a manner known to persons skilled in the art. In addition, an hydraulic pitch control unit 34 is connected between the vehicle and the work attachment 12 to permit operator selection of the fore-aft pitch orientation of the work attachment. The illustrative front end loader 10, as described above, corresponds generally with the front end loader shown and described in U.S. Pat. No. 3,231,117, which is incorporated by reference herein. Such front end loaders are generally referred to as skid-steer loaders, and are commercially available under the trademark BOBCAT from Melroe Company, a division of Clark Equipment Company, Fargo, N. Dak.

Removable mounting of the selected work attachment 12 is facilitated by use of an adapter mounting plate 36, as shown in FIG. 2. More particularly, FIG. 2 illustrates the adapter mounting plate in the form of a generally rectangular base structure having a clevis 38 positioned centrally on a rear side thereof for connection to an extensible ram 40 of the pitch control unit 34. A pair of transversely extending and generally coaxially oriented link pins 42 project outwardly from the lower, laterally opposed ends of the adapter plate 36, at a location below the clevis 38, to provide a pivot connection to the front lower ends 28 of the lift arms 24. An angularly set upper margin 44 of the adapter plate 36 has a size and shape to nest beneath an angularly set retainer bracket 46 formed on a rear face of the work attachment 12. When the upper margin 44 of the adapter mounting plate 36 is nested beneath the retainer bracket 46, spring-loaded lock pins 48 (FIGS. 3 and 4) are receivable into lock ports 50 formed in a horizontal lower shelf 52 on the work attachment. The lock pins 48 can be retracted from the lock ports 50, to accommodate disassembly of the work attachment 12 from the adapter plate 36, by means of manually pivotable release levers 54. The above-described connection structure for removably mounting a selected work attachment 12 onto the adapter mounting plate 36 is described in more detail in U.S. Pat. No. 3,672,521, which is also incorporated by reference herein.

In general terms, the blade tilt assembly 16 comprises a pair of hydraulic tilt units 56 connected respectively between the front lower ends 28 of the lift arms 24 and the adapter mounting plate 36. The tilt units 56 are designed to raise one end of the mounting plate 36 while correspondingly lowering the opposite end through an equal stroke increment, resulting in lateral tilt adjustment of the work attachment 12 mounted to the adapter plate 36. In accordance with one primary aspect of the invention, this bidirectional tilt adjustment of the work attachment 12 is particularly advantageous when a scope or bucket is used having a laterally extending blade edge 58 (FIG. 1), since the blade edge is not skewed with respect to a forward angle of attack. The blade edge 58 may thus be tilted to elevate the right end, or the left end, with corresponding lowering of the opposite end, in accordance with the desired earth-moving or grading operation, and without skewing the angle of attack. Although the blade tilt assembly 16 is shown and described with respect to the adapter mounting plate 36 which is connected in turn to the work attachment 12, it will be understood that the invention may be implemented in a direct connection between the lift frame 14 and the work attachment 12.

Figure 3:
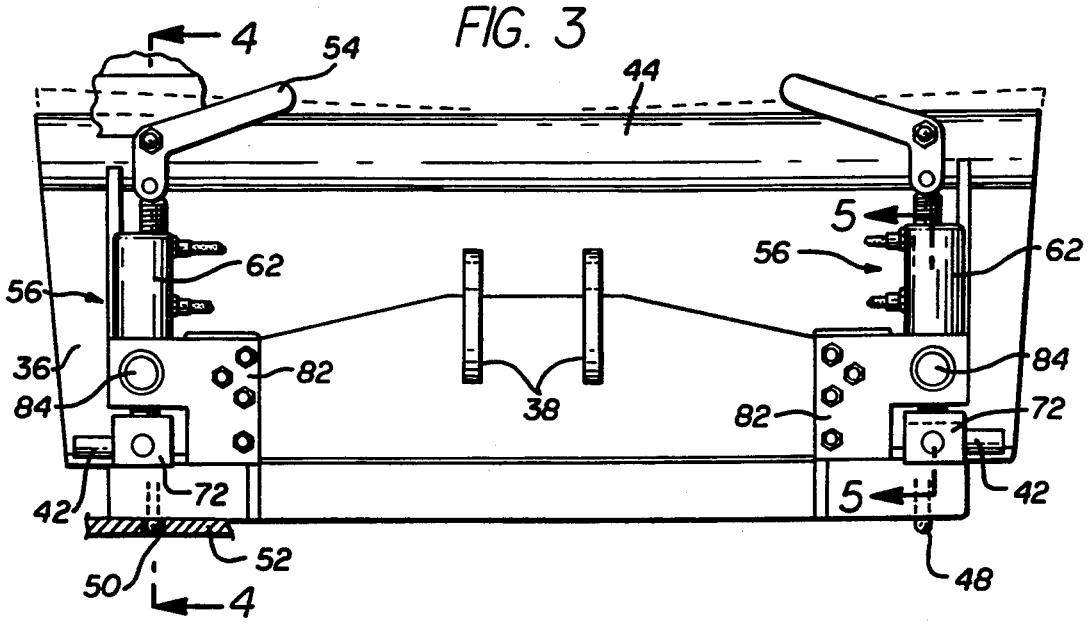
FIG. 3 is a rear elevation view showing the blade tilt assembly and related work attachment of FIG. 2.
Figure 4:
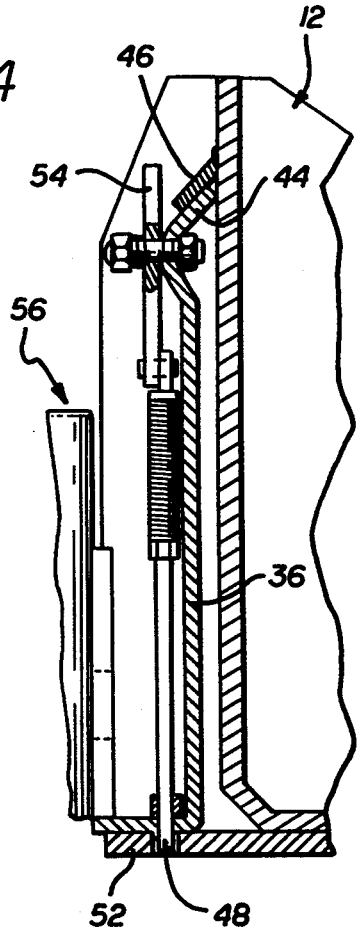
FIG. 4 is an enlarged fragmented vertical sectional view taken generally on the line 4—4 of FIG. 3.
Figure 5:
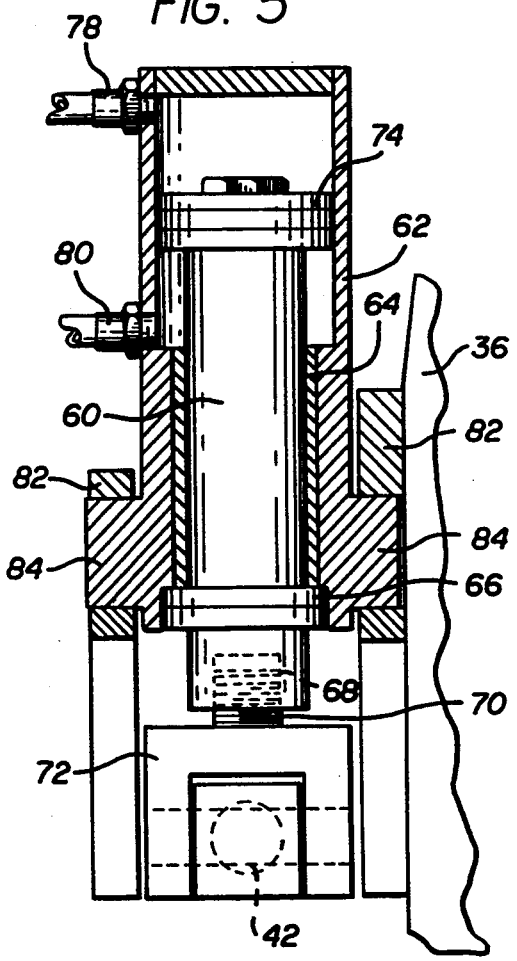
FIG. 5 is an enlarged fragment vertical sectional view taken generally on the line 5—5 of FIG. 3.

As shown in FIGS. 2, 3 and 5, each of the hydraulic tilt units 56 comprises a generally vertically oriented ram 60 mounted slidably within an hydraulic cylinder housing 62, having an open lower end. The ram 60 is disposed predominantly in a concealed position within the housing interior, with a major portion of the ram length supported structurally by an elongated bearing sleeve 64 of brass or the like. In the preferred form, the ram 60 has a substantial cross sectional size or the order of at least about two inches, thereby providing a rigid structure supported for an extended length to accommodate the high stress forces applied during typical earth-moving and grading applications.

A lower end of the ram 60 of each tilt unit 56 extends through a dirt and oil seal assembly 66 to protrude a short distance from the lower end of the hydraulic cylinder housing 62. The ram 60 terminates in a threaded bore 68 for thread-in reception of a stud 70 which projects upwardly from a connector block 72. As shown best in FIGS. 2 and 3, the connector block 72 in turn carries one of the link pins 42 which is connected to the front lower end 28 of the adjacent lift arm 24.

The upper end of each ram 60 of the hydraulic tilt units 56 includes a piston 74 disposed within a chamber 76 between a vertically spaced pair of hydraulic fluid ports 78 and a 80. Accordingly, with reference to FIG. 5, supply of hydraulic fluid under pressure to one side of the piston 74, while exhausting or venting hydraulic fluid from the other side, results in relative displacement of the ram 60 within the cylinder housing 62.

The cylinder housing 62 of each tilt unit 56 is securely connected to the adapter mounting plate 36 by means of a mounting bracket 82 and a relatively large trunnion bearing 84. More specifically, the trunnion bearing 84 has a large cross section on the order of at least about two inches and is formed integrally with the cylindrical housing 62 to extend generally in a fore-aft direction, the trunnion bearing is rotatably supported by the mounting bracket 82 at the rear side of the adapter plate 36. With this construction, supply of hydraulic fluid under pressure to the top side of the piston 74 effectively elevates the cylindrical housing 62 and the adapter plate 36 connected thereto to correspondingly raise the associated end of the work attachment 12. Conversely, supply of hydraulic fluid under pressure to the lower side of the piston 74 effectively lowers the housing 62 and the mounting plate 36 relative to the adjacent lift arm 24, to correspondingly lower the work attachment 12.

FIG. 6 shows a preferred hydraulic flow circuit for use in conjunction with the pair of tilt units 56 which are connected, as previously described, to the laterally opposite ends of the adapter plate 36. An hydraulic fluid supply 86 on the front end loader 10 and an associated low pressure return 88 are connected through an hydraulic selector valve 90 in series flow relation to the tilt units 56 to raise one end of the work attachment, while lowering the opposite end, and vice versa. More specifically, as viewed in FIGS. 6, the vehicle operator can manipulate the selector valve 90 to supply hydraulic fluid under pressure through a first conduit 94 to the top side of one piston 74, while exhausting hydraulic fluid from the bottom of that piston through a branch conduit 92 to the bottom of the opposite piston 74. This arrangement effectively supplies said opposite piston with hydraulic fluid under pressure at the bottom thereof, while the top of said opposite piston is exhausted via a second conduit 96 through the selector valve 90 to the return 88. The two pistons 74 are thus subjected to hydraulic pressure in an equal and opposite manner, to correspondingly achieve equal and opposite displacement of the work attachment. Of course, the selector valve 90 may be manipulated to reverse the connection of the supply 86 and low pressure return 88 to the first and second conduits 92 and 96, thereby reversing the application of hydraulic fluid under pressure to the pistons 74 in a manner which correspondingly reverses the direction of blade tilt adjustment.

The present invention thus provides a relatively simple system and method for achieving bidirectional tilt of a work attachment in a front end loader environment. The disclosed tilt units 56 include structurally reinforced hydraulic rams which are substantially sealed to avoid dirt and grit contamination, without requiring open ball joints or slide tracks in an earth-moving or other dirt-handling environment. The hydraulic rams 60 and associated trunnion bearings provide an essentially self-contained structure with a small number of moving parts wherein the rams and trunnion bearings readily withstand forces applied to the structure during a work procedure.

A variety of further modifications and improvements to the blade tilt assembly of the present invention will be apparent to those skilled in the art. Accordingly, no limitation on the invention is intended by way of the foregoing description and accompanying drawings, except as set forth in the appended claims.

What is claimed is:

1. A blade tilt assembly for a front end loader having a lift frame adapted for connection to a work attachment and including lift means for operating the lift frame to raise and lower the work attachment, said blade tilt assembly comprising:

a pair of hydraulic tilt units each including a ram slidably mounted within a cylinder housing and respectively disposable generally at laterally opposite ends of the work attachment;

means for connecting each of said tilt units between the lift frame and the work attachment whereby displacement of said ram within said cylinder housing of each of said tilt units displaces the work attachment relative to the lift frame, said connecting means comprising coaxially aligned and generally laterally extending link pin means for pivotally connecting said tilt units to the lift frame, and trunnion bearing means oriented to extend generally perpendicular to said link means, said trunnion bearing means for pivotally connecting said tilt units to the work attachment; and control means for supplying hydraulic fluid under pressure to said tilt units to displace the rams of said tilt units in substantially equal increments in opposite directions.

2. The blade tilt assembly of claim 1 wherein each of said tilt units is connectable between the lift frame and the work attachment to displace the work attachment generally in a vertical direction in response to displacement of said ram within said cylinder housing.

3. The blade tilt assembly of claim 1 wherein said link pin means includes means for connecting said rams of said tilt units to the lift frame, and further wherein said trunnion bearing means includes means for connecting said cylinder housings of said tilt units to the work attachment.

4. The blade tilt assembly of claim 1 wherein said ram of each of said tilt units has a piston mounted generally at one end thereof within said cylinder housing, said ram extending from said piston to an opposite end disposed outside said cylinder housing, and further including an elongated sleeve bearing within said cylinder housing for slidably supporting a major portion of the length of said ram.

5. The blade tilt assembly of claim 1 wherein said control means comprises an hydraulic flow circuit connected to said tilt units in series flow relation, and selector valve means for connecting said flow circuit to a supply of hydraulic fluid under pressure and to a low pressure return.

6. The blade tilt assembly of claim 1 further including an adapter mounting plate having means for removable connection to the work attachment, said tilt units being connected between the lift frame and said adapter mounting plate.

7. A blade tilt assembly for a front end loader having a lift frame including a pair of lift arms with front ends disposed generally at a front end of the loader, said lift arms being adapted for connection to a work attachment, and means for operating the lift frame to raise and lower the work attachment, said blade tilt assembly comprising:

a pair of hydraulic tilt units connectable respectively between the work attachment and the pair of lift arms, said hydraulic tilt units each including a ram slidably mounted within a cylinder housing and said hydraulic tilt units being disposable generally at opposite ends of the work attachment;

means for connecting said tilt units between the work attachment and a respective one of the lift arms, whereby displacement of said rams within said housings displaces the work attachment relative to said rams, said connecting means comprising coaxially aligned and generally axially extending link pin means for pivotally connecting said tilt units to said lift arms, and trunnion bearing means oriented to extend generally perpendicular to said link pin means, said trunnion bearing means for pivotally connecting said tilt units to the work attachment;

control means for supplying a hydraulic fluid under pressure to said tilt units to displace said rams within said housings;

said rams of said tilt units each having a piston mounted generally at one end thereof within the respective cylinder housing, and extending from said piston to an opposite end disposed outside said respective cylinder housing, and further including an elongated sleeve bearing within said respective cylinder housing for slidably supporting a major portion of the length of said ram.

8. The blade tilt assembly of claim 7 further including an adapter mounting plate having means for removable connection to the work attachment, said tilt units being connectable between said lift arms and the mounting plate.

9. A blade tilt assembly for a front end loader having a lift frame including a pair of lift arms with front ends disposed generally at a front end of the loader, said lift arms being adapted for connection to a work attachment, and means for operating the lift frame to raise and lower the work attachment, said blade tilt assembly comprising:

a pair of hydraulic tilt units connectable respectively between the work attachment and the pair of lift arms;

said hydraulic tilt units each including a ram slidably mounted within a cylinder housing and said hydraulic tilt units being disposable generally at opposite ends of the work attachment;

means for connecting said tilt units between the work attachment and a respective one of said lift arms, whereby displacement of said rams within said housings displaces the work attachment relative to said rams, said connecting means comprising coaxially aligned and generally axially extending link pin means for pivotally connecting said tilt units to the lift frame, and trunnion bearing means oriented to extend generally perpendicular to said link pin means, said trunnion bearing means for pivotally connecting said tilt units to the work attachment; and control means for supplying hydraulic fluid under pressure to said tilt units to displace the rams of said tilt units in substantially equal increments in opposite directions;

said rams of said tilt units each having a piston mounted generally at one end thereof within said housing and said ram extending from said piston to an opposite end disposed outside said cylinder housing, and further including an elongated sleeve bearing within said cylinder housing for slidably supporting a major portion of the length of said ram.

10. The blade tilt assembly of claim 9 wherein each of said tilt units includes means for connection between the lift frame and the work attachment to displace the work attachment generally in a vertical direction in response to displacement of said ram within said cylinder housing of each of said tilt units.

11. The blade tilt assembly of claim 9 wherein said control means comprises an hydraulic flow circuit connected to said tilt units in series flow relation, and selector valve means for connecting said flow circuit to a supply of hydraulic fluid under pressure and to a low pressure return.

* * * * *